United States Patent [19]

Negishi et al.

[11] 4,345,425

[45] Aug. 24, 1982

[54] PROCESS FOR MAKING BULKY TEXTURED MULTIFILAMENT YARN

[75] Inventors: Takao Negishi; Kazuo Tomiita, both of Otsu, Japan

[73] Assignee: Toray Industries, Inc., Tokyo, Japan

[21] Appl. No.: 213,370

[22] Filed: Dec. 5, 1980

Related U.S. Application Data

[62] Division of Ser. No. 13,198, Feb. 16, 1979, abandoned.

[51] Int. Cl.[3] ..... D02G 3/34; D02G 1/20; D02J 1/08

[52] U.S. Cl. ..... 57/289; 57/333; 57/350; 57/351; 28/271

[58] Field of Search ..... 57/282, 284, 333, 350, 57/351, 908, 208, 209, 244, 246, 289, 310, 290; 28/252, 271, 274

[56] References Cited

U.S. PATENT DOCUMENTS

| | | | |
|---|---|---|---|
| 3,017,737 | 1/1962 | Breen | 57/208 X |
| 3,105,349 | 10/1963 | Palm et al. | 57/208 X |
| 3,174,271 | 3/1965 | Edwards et al. | 57/208 X |
| 3,433,007 | 3/1969 | Myers | 57/209 X |
| 3,938,227 | 2/1976 | Kawasaki et al. | 57/208 X |
| 3,972,174 | 8/1976 | London et al. | 57/908 X |
| 4,051,660 | 1/1977 | Griset | 57/208 X |
| 4,069,565 | 1/1978 | Negishi et al. | 57/208 X |
| 4,070,815 | 1/1978 | Negishi et al. | 57/890 X |

*Primary Examiner*—Donald Watkins
*Attorney, Agent, or Firm*—Austin R. Miller

[57] ABSTRACT

A bulky textured multifilament yarn comprises sections of interlaced individual filaments and sections of non-interlaced individual filaments, wherein the interlaced and non-interlaced sections are formed alternately along the lengthwise direction of the yarn, the filaments in any predetermined length of the yarn are substantially identical in length, and some portions of the individual filaments protrude out from the axis of the yarn. The yarn is made by slackening a multifilament yarn treated by a false twisting operation, and then by interlacing the slackened multifilament yarn by means of a fluid jet stream while taking up the multifilament yarn.

9 Claims, 25 Drawing Figures

PROCESS FOR MAKING BULKY TEXTURED MULTIFILAMENT YARN

This is a division of application Ser. No. 13,198, filed Feb. 16, 1979, now abandoned.

BACKGROUND AND FIELD OF THE INVENTION

The present invention relates to a bulky textured multifilament yarn and to a process for making such yarn. More particularly, the present invention relates to a textured multifilament yarn which is provided with bulkiness due to portions of its filaments protruding from the yarn axis, which portions do not disappear under application of a certain tension as will be defined hereinafter, and also to a process for making such textured multifilament yarn. According to the present invention, portions of the protruding filaments exhibit snarled, looped and/or slackened configurations.

DESCRIPTION OF THE PRIOR ART

Already well known are various types of textured multifilament yarns, which are provided with bulkiness due to portions of filaments protruding from the yarn axis. In a typical well-known bulky textured multifilament yarn, the multifilament yarn is jetted with compressed air at a high velocity and taken up in a direction transverse to the direction in which the jetting operation occurs. The individual filaments of the yarn thus obtained are axially and somewhat continuously interlaced, and the portions of filaments protruding out from the yarn axis exhibit substantially looped conditions. The most serious drawback of such yarn lies in the fact that, when the yarn is subjected to a tension, the protruding filament portions readily disappear. To overcome such drawback, the yarn is subjected to a binding effect of a high degree in a subsequent treatment process (e.g., a yarn which has a denier of 75 and 36 filaments is subjected to a first twisting operation at a rate of 1000 turns per meter; thereafter, three of the first-twisted yarns are subjected together to a second twisting operation at a rate of 700 turns per meter) to obtain, for example, a sewing-machine thread. Even when subjected to the binding effect of such a high interlacing degree, the protruding filament portions disappear under tension well before breakage of the yarn. It is not preferred to use such yarn in general clothing fabrics because of the spongy elasticity of the resultant fabric caused by the protruding looped filaments, and because the fabrics have particularly undesirable feel, which is not suitable for satisfying the consumer's demand for the so-called fluffy touch.

The above-mentioned prior art process will now be described in more detail. Such process employs a fluid jet device of the so-called aspirator type. By this device, a fluid such as air is derived from a pressure source and jetted at sonic or supersonic velocity to create a suction for drawing a multifilament yarn. Thereafter, the yarn is discharged from the device together with the jetted fluid stream. The multifilament yarn thus discharged is then taken up in a direction transverse to the direction in which the jetted fluid flows. During this discharging step, as the feed rate of the multifilament yarn to the fluid jet device exceeds the take-up rate thereof approximately by twelve to fifty percent, it is believed that the velocity as well as the tension of the discharged multifilament yarn is suddenly reduced and that the successively discharged component filaments are interlaced so as to form looped, slackened and/or snarled portions to thereby form the above-mentioned yarn. Accordingly, such yarn structure can be obtained not only by carrying out this typical prior art process but also by carrying out other similar well-known processes.

The yarn obtained by the above-mentioned typical process will now be described in detail. Such yarn has a plurality of loops, slacks, snarls, etc., and is very preferable in the field of knitted articles such as double-knitted fabric because of its high bulkiness and resiliency. However, the dimensional stability of the yarn and the retentivity of the loops, slacks, snarls, etc. are insufficient for obtaining excellent articles in the field of sewing-machine threads, warp-knitted fabrics, woven fabrics, etc. Concerning the above-mentioned process for making such yarn, many problems still remain to be solved, for example: (1) when the above-mentioned fluid is flowing at a high velocity, a remarkably undesirable noise is generated, (2) the high consumption of fluid during the texturing process greatly increases the manufacturing costs, (3) any violent movement of the multifilament yarn wears out the device locally and changes the performance thereof as time elapses, (4) and the characteristic features of the texturing device are sometimes changed due to the presence of certain small substances such as oiling agents and component materials of the multifilament yarn which become locally accumulated on the device as time elapses. Furthermore, an extremely high degree of precision is required during the manufacture of the device, and strictly accurate adjustments are required when the device is being used. Thus, many problems still remain to be solved before the device can be practically used.

SUMMARY OF THE INVENTION

In view of the drawbacks of the above-mentioned conventional textured yarn, it is the object of the present invention to provide a novel bulky textured yarn which has increased stability in the protruding filament portions and which exhibits an improvement in feel or touch, and to provide a novel process for making such bulky textured yarn.

The above-mentioned objects of the present invention are attained by producing the following textured multifilament yarn while using a particular process for manufacturing the yarn. That is, the bulky textured yarn according to the present invention comprises a plurality of individual filaments having false-twisted crimps, wherein each filament has a substantially identical length, the yarn is provided with interlaced sections and non-interlaced sections alternately formed along the lengthwise direction thereof, and the component filaments partially form portions protruding out from the yarn axis. The process for manufacturing the above-mentioned bulky textured multifilament yarn comprises the successive steps of false twisting thermoplastic yarn, then slackening the thus false-twisted multifilament yarn, and then interlacing the individual filaments of the processed yarn. By false-twisting and slackening the yarn, points of the slackened individual filaments, which points correspond respectively to points of the individual filaments located on any given imaginary plane intersecting perpendicularly the axis of the yarn (prior to the slackening process), are distributed irregularly along the lengthwise direction of the false-twisted and slackened yarn. We will hereinafter refer to such irregular distribution of points as an irregular distortion of filaments. By the interlacing treatment, the above-mentioned yarn configuration of the irregular distortion of filaments is firmly determined by the interlaced individual filaments while some portions of the individual filaments are caused to protrude partially from the axis of the thus-produced interlaced yarn.

DETAILED DESCRIPTION OF PREFERRED EMBODIMENTS

Figure 1:
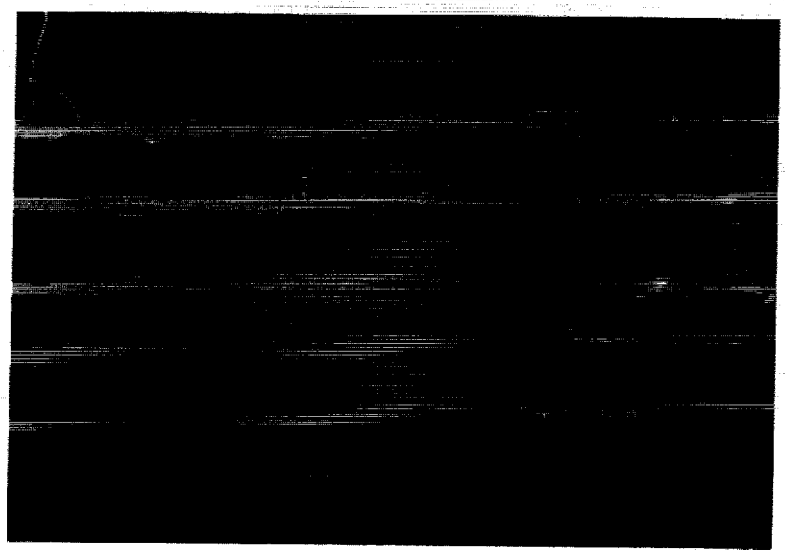
FIG. 1 is an enlarged photograph of a bulky textured multifilament yarn according to the present invention.

The present invention will now be described in detail. As shown in FIG. 1, the bulky textured multifilament yarn according to the present invention comprises a plurality of crimped individual filaments which form interlaced sections and non-interlaced sections distributed alternately along the longitudinal direction of the yarn. This textured yarn is provided with a plurality of individual filament portions protruding out from the axis of the yarn in the form of snarls, loops, or slackened portions. Because of the existence of such protruding filament portions, the bulkiness of the textured yarn according to the present invention is enhanced. Some of the protruding filament portions may be formed in a twisted condition, particularly when such protruding portions are snarled.

A feather touch of the yarn can be obtained according to the present invention because of the protruding filament portions formed in the yarn which do not disappear easily.

The protruding filament portions are relatively stable even when subjected to tension, since the component filaments are interlaced intermittently along the yarn axis. Generally, since a multifilament yarn is basically composed of a plurality of filaments which are substantially identical in their length and which extend parallel to one another, even though such multifilament yarn is subjected to an interlacing treatment so as to interlace the component individual filaments with each other, the interlaced portions of the interlaced yarn can become uninterlaced. Thus, it is obvious that, corresponding to the section in which the component filaments are interlaced, there is another section or sections in which the component filaments are so interlaced as to counterbalance the first-mentioned interlaced section. In the case where the component filaments are continuously interlaced along the yarn axis, the above-mentioned counterbalancing interlaced relationships exist closely adjacent to each other, so that such interlaced relationships are easily destroyed when a tension is applied thereto. As a result, the protruding portions of the filaments will readily disappear. The bulky textured yarn according to the present invention often has a configuration wherein two adjacent interlaced sections are interposed by a non-interlaced section; therefore, the interlaced sections are not easily destroyed even when tension is applied thereto. Furthermore, when a certain filament in the multifilament yarn comprising filaments having a substantially identical length forms a protruding filament portion, it is clear that all of the remaining filaments also form protruding filament portions having a length corresponding to that of the above-mentioned one protruding portion. Consequently, the protruding portions formed by the respective filaments are spaced at short distances from one another when the component filaments are continuously interlaced along the yarn axis. As a result, the interlaced portions will disappear easily when tension is applied thereto. On the contrary, in the bulky yarn according to the present invention, the protruding filament portions formed by the respective component filaments are spaced at wide distances from one another. As a result, the resistance to the movement of individual filaments along the lengthwise direction of the yarn becomes sufficiently high to prevent the protruding filament portions from disappearing when tension is applied thereto. One of the most important features of the bulky textured multifilament yarn according to the present invention resides in the fact that if this yarn is cut at a specified length, the component filaments thereof will all have a substantially identical length. As will be clearly understood from the explanation of the process for making the bulky textured multifilament yarn of the present invention, which will be described hereinafter, the above-mentioned feature is essentially distinguished from a bulky textured multifilament yarn obtained by using a process comprising the steps of feeding two multifilament yarns separately at different feeding rates, i.e., feeding one multifilament yarn at a rate higher than that of the other multifilament yarn, or feeding one multifilament yarn alternately at a rate higher than that of the other multifilament yarn and at a rate lower than that of the other multifilament yarn such as is disclosed in Japanese Patent Publication No. 11585/78, doubling these two multifilament yarns together, and subjecting this doubled-yarn to an interlacing process using a fluid jet to form an interlaced bulky yarn having protruding portions made of the over-fed multifilament yarn.

The feature of the component filaments of the yarn having a substantially identical length is described as follows.

Figure 2A:
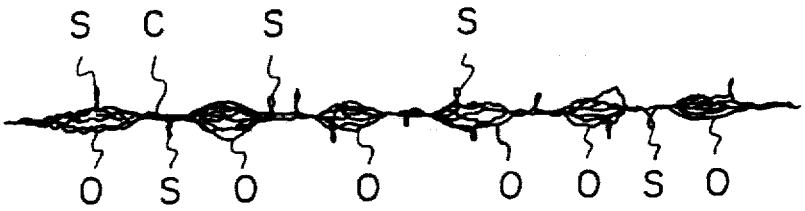
FIG. 2A is a schematic view of a bulky textured multifilament yarn of the present invention having alternating interlaced sections and non-interlaced sections.
Figure 2B:
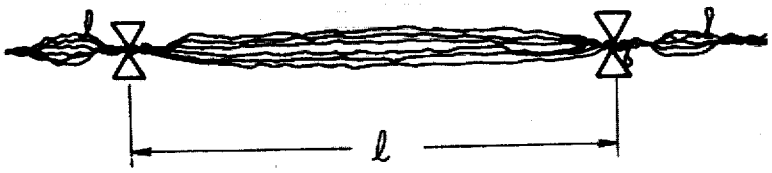
FIG. 2B is a schematic view of a bulky textured multifilament yarn wherein some interlaced sections are uninterlaced.

According to the present invention, and referring to FIG. 2A of the drawings a bulky textured multifilament yarn having alternating interlaced sections C and non-interlaced sections O and being provided with protruding filament portions S, as shown in FIG. 2A, is used as a sample. The interlaced relationship of the yarn is partially removed so that the non-interlaced section has a length of 10±2 cm, i.e., a length of between eight and twelve cm, as shown in FIG. 2B. If all of the component filaments are straightened under a tension of 0.3 g/D, this yarn can be defined as being composed of component filaments of a substantially identical length, where D designates the denier and, accordingly, 0.3 g/D is a relatively low tension.

In the yarn according to the present invention, the component filaments of the yarn are of a substantially identical length, such as the specified length of 10±2 cm, within a relatively short section thereof. Such condition provides the effect that even when the yarn is scraped in the longitudinal direction, neither naps nor slub formed by the accumulation of a plurality of the protruding portions displaced or shifted under such a scraping effect. That is, in the bulky textured multifilament yarn according to the present invention, differences in length of the component filaments located within a very short length of the yarn are effectively compensated within a relatively short section of the yarn such as a specified length of 10±2 cm. Therefore, it is almost impossible to create naps and slubs by the possible displacement of the protruding portions along the lengthwise direction of the yarn.

The above-mentioned definition of the yarn is not applicable to the case where a part of the component filaments is fed at a rate higher than that of the other part of the component filaments so as to form the protruding portions.

According to the present invention, a bulky textured multifilament yarn having protruding portions is one which has portions protruding out from the yarn axis under a tension of 0.3 g/D. Accordingly, a yarn in which all of its protruding filament portions disappear under a tension of 0.3 g/D is not involved in the present invention, and such filament portions which disappear under the above-mentioned tension cannot be defined as "protruding filament portions".

For improving the bulky yarn according to the present invention, it is important that the protruding filament portions in the slackened condition be principally formed in the non-interlaced sections. In the non-interlaced sections, since the component filaments do not at all interact with one another, a plurality of protruding filament portions in the slackened condition are therefore formed, thus contributing to an improved bulkiness of the yarn.

Protruding filament portions are also formed in the interlaced sections of the yarn. In this case, the roots of such protruding portions are fixed by the interlacing relationship of the component filaments. These protruding filament portions will provide the desired fluffy touch, and create a pilling resistance after being woven into a fabric.

According to the present invention, the protruding filament portions of the bulky yarn may have one of three forms, i.e., snarl, loop and slack, or two or more of these forms.

The novel bulky yarn having stably fixed protruding filament portions as described hereinabove is made by carrying out the process comprising the steps of feeding a thermoplastic multifilament yarn, subjecting the thus-fed yarn to a false-twist texturing process to provide the yarn with various crimping and torque properties along axes of the respective component filaments, then slackening thus-textured yarn to develop crimps on the respective component filaments to create irregular distortions thereof along the yarn axis, and subjecting the thus-produced yarn to an interlacing device of the fluid jet type to effect interlacing of the component filaments so that the irregular distortions of the component filaments are fixed, and a plurality of protruded filament portions are caused to protrude stably from the yarn axis.

The process for making the bulky yarn according to the present invention as mentioned above will now be described in more detail.

The yarn to be supplied to the process according to the present invention can be a thermoplastic multifilament yarn, such as a polyester, polyamide, polyolefine or polyvinyl yarn, a thermoplastic multifilament yarn consisting of a plurality of composite filaments composed of two or more of these polymers, or of at least two groups of the above-mentioned filaments, or a thermoplastic multifilament yarn which can be provided with crimping and torque properties by applying a twisting-heating-untwisting treatment thereto. As the yarns to be fed, drawn yarns or undrawn yarns can be used. However, a polyester multifilament yarn or a polyamide multifilament yarn is particularly preferable.

The process according to the present invention comprises three important steps as will be explained hereinafter.

The first step is a step of twisting the thermoplastic multifilament yarn, heating the thus-twisted yarn, and then untwisting the yarn to provide the component filaments thereof with potential crimping and torque characteristics of various degrees.

Figure 3:
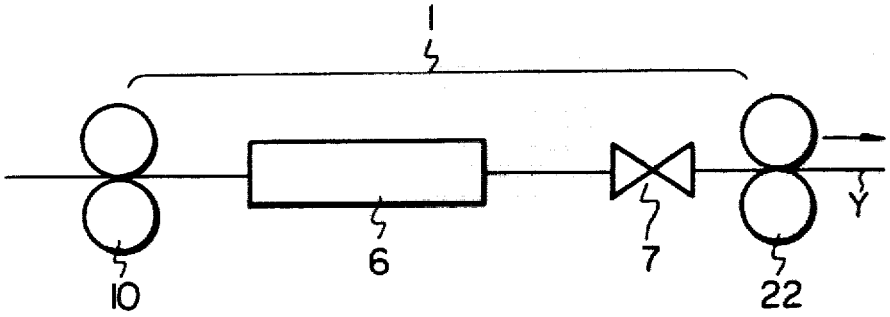
FIG. 3 is a schematic view of an embodiment of the false-twisting step in the process of the present invention.

FIG. 3 schematically shows such first step, in which the multifilament yarn Y is fed by rollers 10 into a false twist processing zone 1 wherein the yarn Y is twisted by a false twister 7, and heated by a heater 6 while being false twisted; thereafter, the yarn is delivered from the false twister 7 and then taken up by rollers 22. Thus the first step is completed.

The second step of the process according to the present invention (during which step slackening of the multifilament yarn false-twisted by the first step is effected to develop crimps on the individual filaments of the yarn) is applied after the first step or after the yarn from the first step has been wound into a package. The filaments which are provided with the crimping and torque properties develop actual crimps when they are slackened. However, such crimps are not uniform in size along the respective filament axes, since some of the filaments are present in the inner layers in a multifilament yarn and the others are present in the outer layers in a multifilament yarn during the step of false twisting. In the case where the multifilament yarn to be fed to the false twisting step has already been drawn, variation of crimp size along the filament axes is relatively small, while this variation is relatively large in the case where the multifilament yarn to be fed to the false twisting step is an undrawn yarn and such yarn is subjected simultaneously to false twisting and drawing. In the latter case, small or large crimps appear continuously over a length of several mm or longer. To obtain a higher bulkiness, it is preferable to use the undrawn yarn.

Figure 4A:
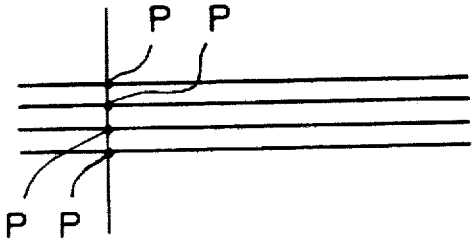
FIGS. 4A, 4B and 4C are schematic views illustrating the irregular distortions of the filaments of the multifilament yarn utilized in the process of the present invention.
Figure 4B:
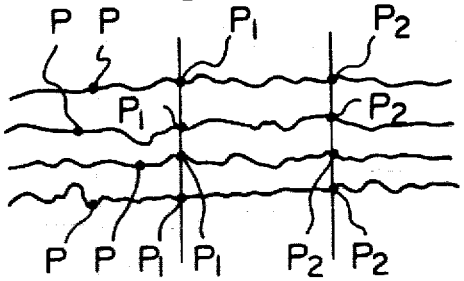
Figure 4C:
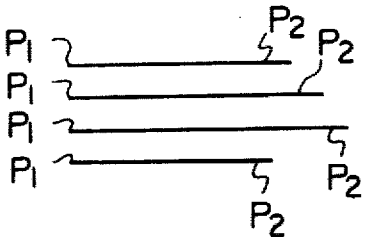
Figure 5:
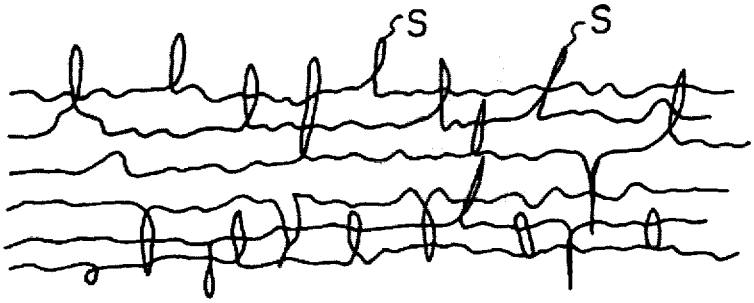
FIG. 5 is a schematic view illustrating a false-twisted and slackened multifilament yarn.
Figure 6:
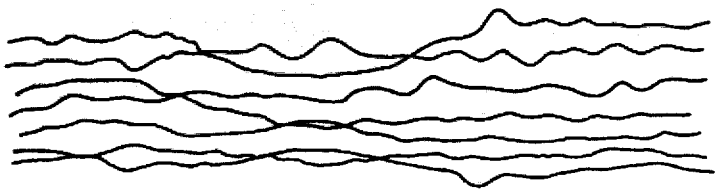
FIG. 6 is a schematic view of another embodiment of a false-twisted and slackened multifilament yarn.
Figure 7:
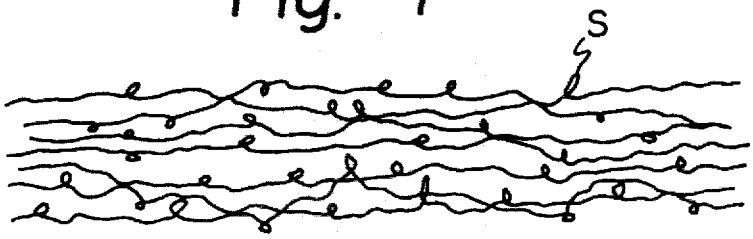
FIG. 7 is a schematic view of a still further embodiment of a false-twisted and slackened multifilament yarn.

The second step of the process according to the present invention, as mentioned above, causes the component filaments to develop crimps and thereby causes irregular distortions of filaments to be produced. FIGS. 4A, 4B and 4C schematically show various conditions of the multifilament yarn for illustratng such irregular distortions of filaments. FIG. 4A shows a condition in which the multifilament yarn (after the above-mentioned first step) is under a tension but without any development of crimps, and FIG. 4B shows a condition in which the multifilament has been slackened and crimps have developed. Points of the respective filaments aligned with one another transversely along the yarn axis as shown in FIG. 4A are irregularly displaced along the yarn axis under the slackened condition as shown in FIG. 4B. The respective filaments contained in a section between two points $P_1$ and $P_2$ along the yarn axis (tnis section is shoter than the section of $10\pm2$ cm) have irregular lengths as shown in FIG. 4C. Such condition corresponds to the feature identified by the expression "irregular distortion of filaments". The degree of such irregular distortion of filaments is greater when the variation of the crimp size in the direction of the yarn axis is relatively large. Accordingly, it is preferred to feed an undrawn multifilament yarn to the false twisting step. The degree of irregular distortion of filaments depends also on the number of false twists. In this respect, the inventors have found that, in a polyester yarn of 150 denier-48 filaments, the degree of irregular distortion of filaments reaches maximum at 1600 turns per meter to 1800 turns per meter and is reduced when the number of false twists is less than or more than the above-mentioned range. The degree of irregular distortion of filaments further depends on the degree of slackening. FIG. 5 shows a condition in which the respective component filaments are provided with protruding portions S in the form of snarls as a result of torque properties developed in the filaments when the yarn under tension is subjected to a relatively high degree of slackening. FIG. 6 shows a condition in which the respective component filaments develop crimps when the tensioned yarn is subjected to a rather low degree of slackening. The degree of irregular distortion of filaments depends also on the manner in which the slackening operation is performed. FIG. 7, for example, shows the case in which the yarn under tension is highly slackened (as shown in FIG. 5) and then partially stretched to an extent that the degree of slackening is the same as that for the yarn shown in FIG. 6. As seen from FIGS. 6 and 7, the protruding filament portions in the form of snarls are formed in some cases but not formed in other cases, even under the same degree of slackening.

Figure 9:
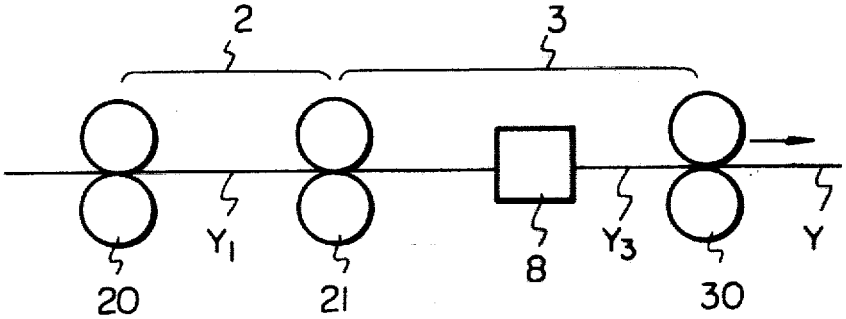
FIG. 9 is a schematic view of an embodiment of the slackening and interlacing steps in the process of the present invention.

The second step is carried out by utilizing two pairs of rollers 20, 21 shown in FIG. 9 wherein the feed speed of the rollers 20 disposed at an upstream position of the zone 2 for slackening the yarn Y delivered from the first step is faster than the feed speed of the rollers 21 disposed at a downstream position of the zone 2.

The third step of the process according to the present invention is a step of interlacing the multifilament yarn after the yarn has been subjected to the second step so as to maintain the irregular distortion of the component filaments of the multifilament yarn.

FIG. 9 schematically shows, by way of example, the second and third steps of the process according to the present invention. In FIG. 9, the multifilament yarn Y is fed by rollers 20 into a slackening zone 2 and taken up by rollers 21, thus completing the second step. The multifilament yarn Y is slackened in the slackening zone 2 to obtain the multifilament yarn $Y_1$ with developed crimps as shown in FIGS. 5 or 6.

According to the process of this invention, the degree of irregular distortion of filaments may be adjusted by adjusting the slackening rate in the slackening zone 2 and, further, by stretching the multifilament yarn after the slackening step and before the interlacing step.

Figure 10:
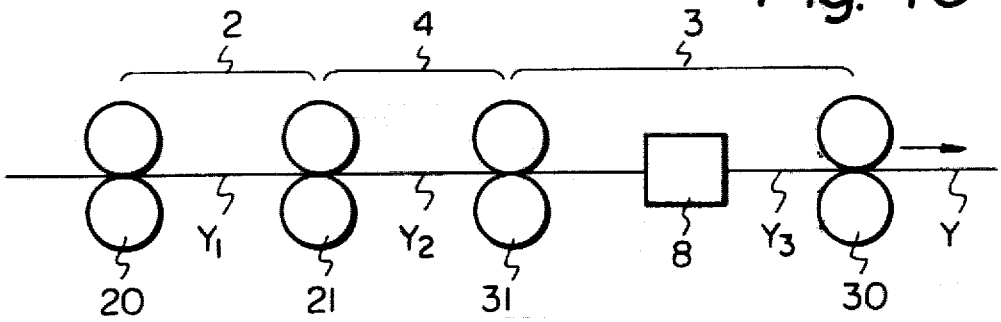
FIG. 10 is a schematic view of an embodiment of the slackening, stretching and interlacing steps in the process of the present invention.

FIG. 10 schematically shows, by way of example, the stretching of the multifilament yarn in the process according to the present invention, in which a zone defined by rollers 20 and 21 corresponds to the slackening zone 2 and a zone defined by the rollers 21 and 31 corresponds to a stretching zone 4. $Y_1$ designates the multifilament yarn Y present in the slackening zone 2 and $Y_2$ designates the multifilament yarn Y present in the stretching zone 4. The yarn Y may taken the form as seen in FIG. 5. The yarn $Y_2$ may take the form as seen in FIG. 7 as previously described.

As seen in FIGS. 9 and 10, the multifilament yarn Y is further fed by the roller 21 or 31 into the interlacing zone 3, introduced into an interlacing device of the fluid jet type 8 and then taken up by rollers 30, thus completing the third step. In the thus-interlaced multifilament yarn Y, the irregular distortion of component filaments in the direction of the yarn axis formed during the previous second step is now securely maintained to provide the bulky yarn according to the present invention.

Figure 11:
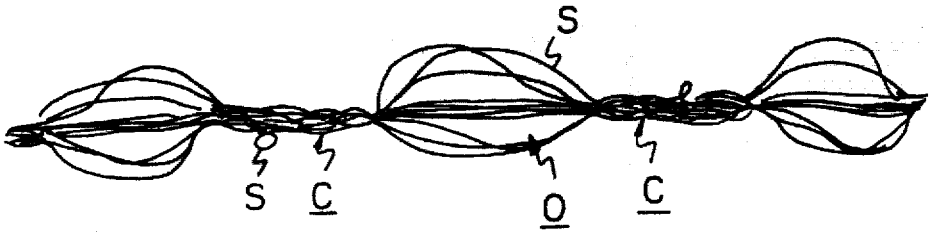
FIG. 11 is a schematic view of a bulky textured multifilament yarn according to the present invention.
Figure 12:
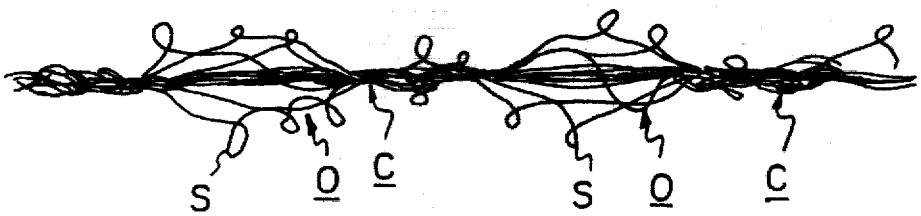
FIG. 12 is another schematic view of a bulky textured multifilament yarn according to the present invention.
Figure 13:
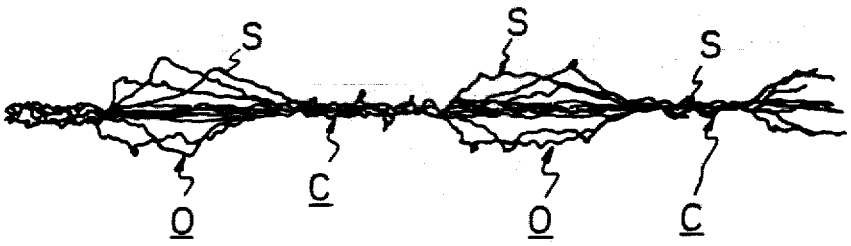
FIG. 13 is a schematic view of a bulky textured multifilament yarn according to the present invention.

FIGS. 11, 12 and 13 are schematic side views showing the condition and appearance of the multifilament yarn obtained in accordance with one preferred embodiment of the present invention, which obtained yarn is interlaced intermittently along the yarn axis. This yarn has alternately interlaced converging sections C and non-interlaced or open sections O along the yarn axis. This yarn is also provided with protruding filament portions S under a predetermined tension (tension of 0.3 g/D as previously mentioned). FIG. 11 schematically shows the case in which the multifilament yarn with a relatively small number of false twists and slackened at a relatively low slackening rate, as shown in FIG. 6, is intermittently interlaced. The yarn has bow-like filament portions S protruding out from the yarn axis, as seen in FIG. 11. FIG. 12 schematically shows the case in which the multifilament yarn with a relatively small number of false twists and with the snarled or looped protruding portions as seen in FIGS. 5 or 7, respectively, while under a slackening effect at a relatively high slackening rate, is intermittently interlaced to form the filament portions S in the form of snarls or loops protruding out from the yarn axis. FIG. 13 schematically shows the case in which the multifilament yarn with a relatively large number of false twists is intermittently interlaced after being slackened to form the filament portions S having fine crimps and protruding out from the yarn axis.

Figure 8:
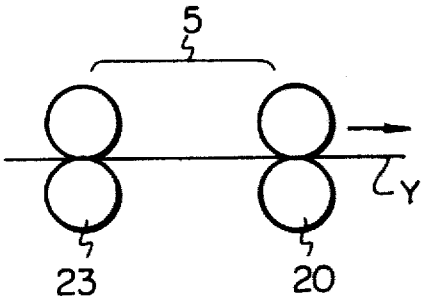
FIG. 8 is a schematic view of an embodiment wherein the stretching step is carried out prior to the slackening step in the process of the present invention.

Such bulky yarn according to the present invention is composed of the component filments fed at a uniform feed rate and having a substantially uniform length, and thus meets the definition as previously given. In any case, the process according to the present invention may be advantageously carried out if the slackening rate as well as the stretching rate is properly adjusted in accordance with the desired process yarn characteristics to be obtained. Furthermore, the steps of the process may be advantageously modified during execution of the process according to the present invention. In the case where a multifilament yarn is first false twisted, wound on a package, and then fed into the slackening zone from the package, or in the case where the component filaments have an extremely high crimping property, the desired irregular distortion of the component filaments may not be readily produced in some cases. In the former case, the crimping and torque properties are maintained in the package; on the other hand, in the latter case the crimping property is too high to create the desired irregular distortions of the component filaments so that an ordinary false twisted and crimped yarn having almost no irregular distortions of the component filaments is produced. To overcome the above-mentioned problem, the multifilament yarn may be stretched in the stretching zone 5 between rollers 23 and 20 as shown in FIG. 8 before being fed into the slackening zone and/or may be heated before being fed into the slackening zone 2 to develop the torque and crimping properties of the filaments or to weaken the crimping property so that the yarn is conditioned in preparation for the subsequent slackening step.

As previously mentioned, a particular range of the numbers of false twists which are imparted to the yarn in the above-mentioned first step is preferred for carrying out the process according to the present invention. According to our experimental tests, it was found that such preferred range of the numbers of false twists per unit meter is expressed by the following formula:

$$2000 \cdot \sqrt[4]{\rho/D} < T < 7000 \cdot \sqrt[4]{\rho/D}$$

where $\rho$ represents a specific gravity of the filaments and D the thickness of the yarn in denier. It is obvious that no irregular distortion of the component filaments can be formed during slackening while using particular numbers of false twists usually imparted to the yarn to obtain the ordinary false-twisted and crimped yarn, and that the range expressed by the formula mentioned above is substantially smaller than the range of false twists applied to obtain ordinary false twisted and crimped yarn.

In carrying out the process according to the present invention, it is preferred to use an interlacing device of the fluid jet type having no yarn-conveying function. The expression "interlacing device of the fluid jet type having no yarn-conveying function" used herein means an interlacing device of such type which does not permit the continuous running of a yarn unless the yarn is taken up by a separate means. Although various kinds of interlacing devices of the fluid jet type having a yarn-conveying function are well known, such well-known interlacing devices only serve to destroy the irregular distortions of the filaments of the multifilament yarn which is fed to the interlacing devices of the fluid jet type; therefore such types of interlacing devices are not suitable for use in the present invention.

When the process according to the present invention is used to obtain bulky yarn having alternating interlaced and non-interlaced sections, which yarn is extremely effective particularly for securing the protruding filament portions, it is obviously preferred to use an interlacing device of the fluid jet type which can produce alternating sections in which component filaments of the yarn are either interlaced or non-interlaced, i.e., to effect intermittent interlacing in the direction of the yarn axis.

FIGS. 14, 15, 16 and 17 schematically show cross-sections of different interlacing devices 8 of the fluid jet type adapted to provide yarn with intermittent interlacing in accordance with the process of the present invention. All of the interlacing devices shown in FIGS. 14, 15, 16 and 17 have a common construction in which the yarn is guided through an interlacing chamber 81 and the fluid is jetted from fluid jet nozzles 82, 83 in a direction tranverse to the direction in which the yarn is guided through the interlacing chamber 81 (i.e., the vertical direction with respect to the plane of the drawing). A gap 84 is provided through which an intermediate portion of the yarn, instead of the end of the yarn, is guided into the interlacing chamber 81.

Figure 18:
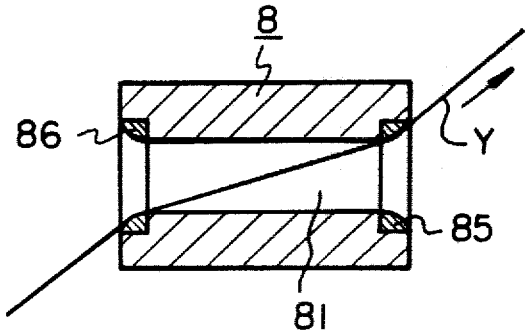
FIGS. 18, 19 and 20 are sectional views respectively showing preferred embodiments of the engagement of a yarn with an interlacing device of a fluid jet type utilized for carrying out the process of the present invention.
Figure 19:
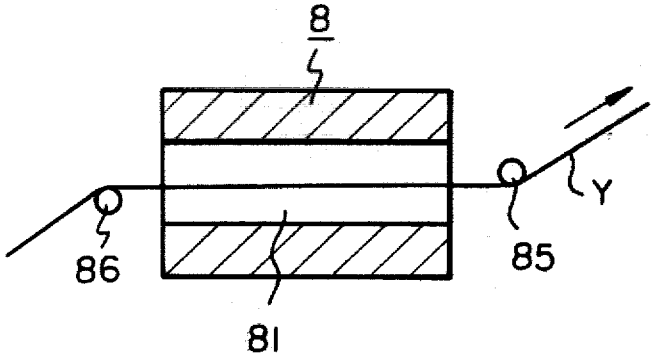
Figure 20:
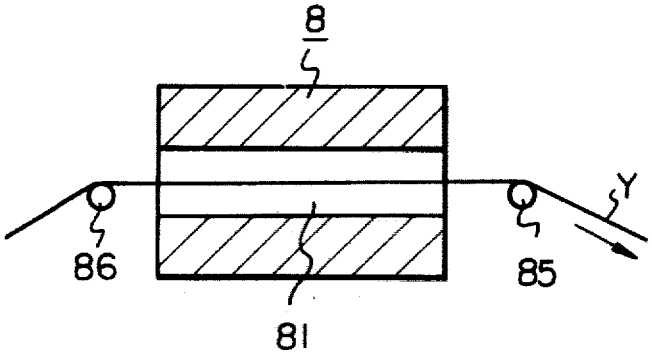

FIGS. 18, 19 and 20 are schematic side views of the interlacing device 8 of the fluid jet type, showing preferred ways in which the yarn can be engaged with the interlacing device according to a preferred embodiment of the present invention. As shown in these drawings, the multifilament yarn Y is bent by bending members 85, 86 at opposite ends of the interlacing chamber 81 or in the areas adjacent thereto, as the yarn Y is guided through the chamber 81 of the interlacing device 8 of the fluid jet type.

When the desired irregular distortion of the component filaments along the yarn axis is formed by slackening, as already described with reference to the step shown in FIG. 10, in carrying out the process according to the present invention, the step of stretching filaments within a particular stretching range, by which such irregular distortion cannot be eliminated, may be added after completion of the slackening operation for creating the irregular distortion of filaments. It should be noted here that, when stretching is thus performed after slackening and before interlacing the multifilament yarn, it is not essential to provide the rollers 21, 31 to define the slackening zone and the stretching zone as shown in FIG. 10, and that slackening as well as stretching may be practically performed by a relatively simple apparatus according to the present invention. Such simple apparatus will now be described with reference to FIGS. 21 and 22.

Figure 21:
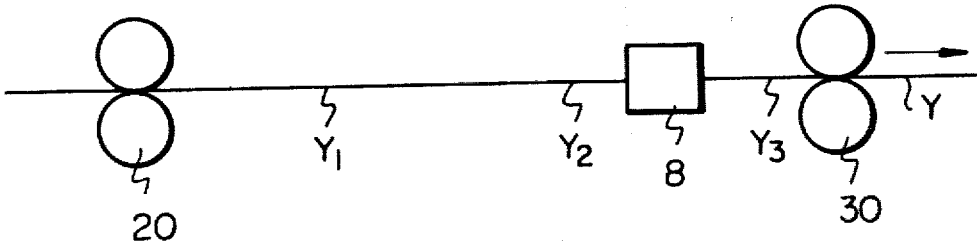
FIG. 21 is a schematic view of an embodiment of the process of the present invention wherein slackening, stretching and interlacing are continuously carried out in one zone.

In FIG. 21 the multifilament yarn Y is successively engaged by the rollers 20, the interlacing device 8 of the fluid jet type and the rollers 30, and no yarn feed rollers are provided between the rollers 20 and the rollers 30. The velocity at which the yarn Y is fed by the rollers 20 depends on the yarn feed rate of these rollers 20, and the velocity at which the yarn is taken up by the rollers 30 depends on the feed rate of these rollers 30. The amount of yarn passed per unit time is constant at any point along the path, along which the yarn is guided. However, the velocity of the passing yarn is under the influence of air resistance developed as the yarn runs, so that the velocity of the multifilament yarn Y which has been fed at the feed rate of the rollers 20 is suddenly decelerated as the yarn leaves the rollers 20. As a result, the yarn is slackened, and then the velocity of the running yarn is again increased as the yarn approaches the fluid jet type interlacing device 8.

The acceleration of the velocity of the running yarn directly provides a stretching effect. The degrees of such slackening and stretching increase in proportion to the velocity as well as to the distance of the yarn passage.

Figure 22:
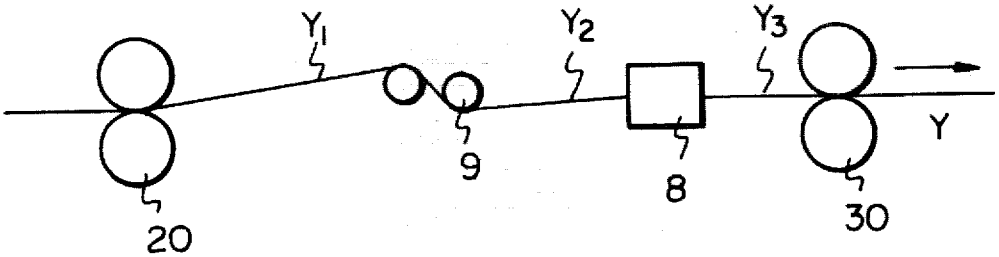
FIG. 22 is a schematic view of an embodiment of the process of the present invention wherein a frictional resistor is provided between the feed rollers and the interlacing device.

In FIG. 22 a frictional resistor 9 is provided and the multifilament yarn is engaged with the frictional resistor 9 between the rollers 20 and the fluid jet type interlacing device 8. Because the multifilament yarn is engaged by the frictional resistor 9, the yarn is thereby subjected to a resistance while passing therethrough so that the yarn tension upstream of the frictional resistor 9 is lower than that downstream of the friction resistor 9, while a yarn $Y_2$ receives the stretching action at a position between the resistor 9 and the interlacing device 8.

In employing such construction of the apparatus according to the present invention, the frictional resistor 9 may be a conventional yarn tensioning device or a rod-like member by which the yarn is curved upon contact therewith.

When the interlacing device 8 is provided with such yarn guides 85, 86 as shown in FIGS. 18, 19 and 20, the yarn guides 85, 86 provide the yarn with resistance during passage, and the yarn is thereby simultaneously stretched and interlaced.

When stretching and interlacing are thus simultaneously effected, the stretching effect obtained is quite different from the stretching effect obtained when stretching the yarn prior to interlacing as previously mentioned, because the multifilament yarn is subjected to a stretching operation at sections in which the component filaments are interlaced. It is obvious that such stretching must be performed without destroying the protruding filament portions, and, in practice, stretching and interlacing are simultaneously performed after the yarn is slackened whereby the desired amount of protruding portions and the degree of such stretching have been previously established. In this manner, relatively stable parts of the protruding portions formed prior to the interlacing step substantially remain after the stretching step, and such remaining protruding portions are interlaced to form protruding filament portions which are securely fixed to the multifilament yarn after interlacing. Compared to the cases in which no stretching is effected during interlacing or in which stretching is not effected during interlacing but after interlacing, the manner in which stretching and interlacing are simultaneously performed provides various advantageous effects, i.e., the protruding portions are firmly secured to the yarn, the respective component filaments contribute highly to improvement of the yarn strength, a dimensional stability of the yarn is improved and the interlaced condition does not readily disappear since irregular distortion of filaments does not occur easily. By using the fluid jet type interlacing device adapted for performing such simultaneous stretching and interlacing, the slackened condition as seen in FIG. 21 may be formed without using any separate rollers between the rollers 20 and the interlacing device 8, so long as the velocity of the yarn passage is relatively low and/or the distance of the yarn passage is relatively short.

The yarn may be suitably stretched at a yarn passage between the interlacing device 8 and the rollers 30 to improve the stability of the protruding portions. When the resistance of the interlacing device 8 to the passage of the yarn causes a slackened condition upstream of the interlacing device 8, stretching may occur at a yarn passage between the interlacing device and the rollers 30. Accordingly, factors such as the feed rate may be appropriately adjusted to obtain a desired stretching effect in such zone.

The bulky yarn according to the present invention may comprise a plurality of component filaments of two or more different types. For example, after all of the component filaments are provided with unidirectional torque property by false twisting in accordance with the present invention, all of the protruding filament portions will have unidirectional torque properties. Such torque properties sometimes vary disadvantageously under the influence of heat treatment or other treatments performed after these yarns are woven into a fabric so that, as a result, the protruding portions are twisted around one another. Torque properties are also strongly developed in the yarn by heat treatment. Subsequently, in knitted fabrics such as plain knittings, the line of stitches becomes oblique. The above-mentioned two drawbacks can be overcome according to the present invention by utilizing two false twisted multifilament yarns of S and Z twist directions, that is, the above-mentioned yarns are fed as yarns to be subjected to the interlacing treatment. That is, two similar multifilament yarns wherein one has been false twisted in the S direction and the other has been false twisted in the Z direction are fed to the slackening process under identical conditions so that substantially identical torque properties in the S direction and in the Z direction with reverse directions of the torque protruding portions twisting around one another can be remarkably reduced. The yarn torque can also be eliminated by such process. Filaments which differ in the following characteristics, i.e., thickness, color, dyeability and thermal absorption, may also be used for carrying out the present invention.

As a result of experimental tests repeated by the inventors, it was found that, according to the process of the present invention, a slackened condition of the yarn upstream of the interlacing device of the fluid jet type can be obtained when the slackening rate is 5% or higher, and that if the slackening rate in such region is lower than the above-indicated level, it then becomes difficult to obtain a yarn according to the present invention.

It should be noted here that the slackening rate is expressed by the following formula, when the yarn running through the slackening zone is cut simultaneously at two different points to obtain a sample of yarn:

$$\left( \frac{\text{average length of cut filaments contained in this sample}}{\text{Distance between two points}} - 1 \right) \times 100\%$$

Provided in accordance with the present invention as described hereinabove is a bulky yarn having protruding filament portions in the form of loops, slacks, snarls, etc., firmly fixed to the yarn and comprising component filaments interlaced with one another.

In the yarn according to the present invention, the stability of the protruding portions is substantially higher than that of the prior art so that these protruding portions can be visually recognized on the surface of the fabric woven or knitted from this yarn. Such fabric exhibits an excellent bulkiness, feel or touch, and surface characteristics, that is, a high slip resistance property is exhibited due to the presence of the protruding portions. In view of the last-mentioned advantage, each fabric is very suitable for anti-gloss taffeta (i.e., spun-like taffetas), pocket linings and belt linings or for bed covers and sheets.

When the yarn according to the present invention is used as a sewing-machine thread, the stability of the protruding portions of such thread is high. In addition, it is possible to perform sewing by means of a sewing-machine without generating a large amount of heat because we believe that a high amount of heat is radiated through the protruding portions and that a low amount of heat is absorbed by the thread.

EXAMPLE 1

Figure 14:
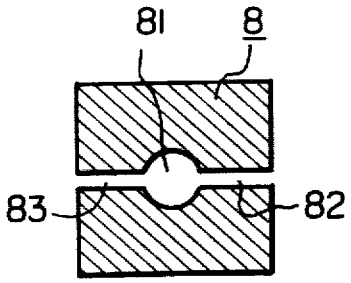
FIGS. 14, 15, 16 and 17 are respective sectional views of embodiments of an interlacing device of the fluid jet type utilized for carrying out the process according to the present invention.
Figure 15:
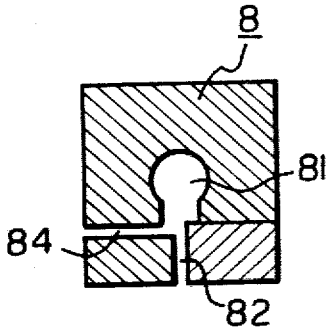
Figure 16:
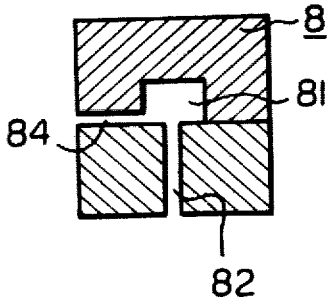

A multifilament yarn (75D (denier), 36 fil. (filaments)) of polyethylene terephthalate is false twisted at a false twist number of 1500 T/m (turns/meter) by a false twister 7 of the spindle type while being simultaneously heated by a heater 6 at 160° C. in the manner as shown in FIG. 3. Then the yarn is subjected to processing by an interlacing device of a fluid jet type in the manner as shown in FIG. 22. The rollers 22 shown in FIG. 3 are identical to the rollers 20 shown in FIG. 22. In this case, the interlacing device 8 as shown in FIG. 18 is used, and the cross-section of the interlacing device is as shown in FIG. 14. The yarn feed rate of the rollers 30 functioning as take-up rollers in the interlacing zone is 135 m/min., the yarn feed rate of the rollers 20 functioning as feed rollers for feeding a yarn into the slackening zone is 150 m/min., the slackening rate of $Y_1$ is 65% and the slackening rate of $Y_2$ is 27%. The stretching provided by the frictional resistor 9 is calculated thereby to be approximately 1.3 times. The slackening rate of $Y_1$ is 12%. Accordingly, the yarn is stretched at a rate of 1.14 times and simultaneously interlaced. The yarn obtained under the above requirements according to the present invention takes the form as shown in FIG. 1, in which a plurality of snarls are stably formed in the yarn so as to remain stable even under a tension sufficiently high enough to break the yarn. The yarn strength is as high as 80% of the total strength of the filament's strength.

EXAMPLE 2

A multifilament yarn (120D, 36 fil. (filaments)) is obtained by melt-spinning polyethylene terepthalate, namely, by taking-up at a rate of 3000 m/min. This yarn is then drawn by 1.75 times and at the same time false twisted at a false twist number of 1600 T/m at a temperature of 200° C. in the manner as shown in FIG. 3. Thereafter, the yarn is subjected to processing by the fluid jet type interlacing device as shown in FIG. 21; as a result, a bulky yarn is thereby produced. The yarn delivery rate of the rollers 30 is 365 m/min., and the yarn feed rate of the rollers 20 (common to 22 in FIG. 3) is 400 m/min. The manner in which the yarn is engaged with the interlacing device 8 corresponds to that shown in FIG. 19, and the cross-section of the interlacing device corresponds to that shown in FIG. 15.

Similar to the yarn obtained in Example 1, the bulky yarn according to the present invention obtained in this way exhibits excellent snarl stability and yarn strength.

EXAMPLE 3

A yarn having false twist in the S direction and a yarn having false twist in the Z direction are obtained under the same requirements as those stated in Example 1 and are doubled together upstream of the frictional resistor 9. The yarns thus doubled together are interlaced. The resultant yarn exhibits, in addition to the same effects as those obtained in Examples 1 and 2, no torque property, and is therefore has an excellent property for producing single jersey.

EXAMPLE 4

A multifilament yarn Y (70D, 24 fil., twisted 14 turns/m) of polyethylene terephthalate is false twisted and interlaced in the manner as shown in FIGS. 3 and 21. The processing conditions are as follows:

| | |
|---|---|
| Yarn feed rate of rollers 10 | 213 m/min |
| Yarn feed rate of rollers 20 (common to 22) | 200 m/min |
| Yarn delivery rate of rollers 30 | 178 m/min |
| Temperature of heater 6 | 200° C. |
| Number of revolutions of false twister 7 | $3 \times 10^5$ rpm |
| Pressure at which compressed air is jetted from fluid jet type interlacing device 8 | 3.0 kg/cm$^2$ (G) |

The interlacing device 8 as shown in FIG. 14 is used, and the manner in which the yarn is engaged with the interlacing device as shown in FIG. 18 is employed.

The resultant yarn exhibits an appearance as shown in FIG. 2A, in which the non-interlaced sections O each being 3 to 7 mm long and interlaced sections C each being 5 to 10 mm long are alternately formed and in which a plurality of snarls S are provided. Relatively short snarls S are loop-shaped. These snarls S provide, when the resultant yarn is used for knitted or woven articles, a fluffy feel which is similar to the feel of cotton yarn, but which is more stable than that of cotton yarn.

EXAMPLE 5

Figure 17:
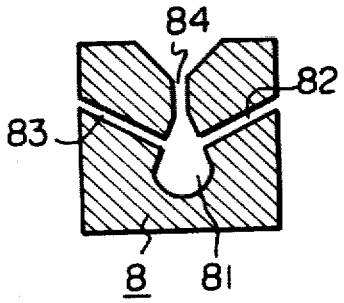

A multifilament yarn (250D, 48 fil.) is obtained by spinning fused polyethylene terephthalate, specifically by taking-up at a rate of 3500 m/min. This yarn is a undrawn multifilament yarn of thermoplastic fibers. The yarn is fed at a feed rate of 400 m/min. to yarn feed rollers 10 in the manner as shown by FIG. 3, and then heated by the heater 6 at a temperature of 210° C., wherein the yarn is simultaneously false twisted at a rate of 2450 T/m by the false twister 7 of a frictional contact type. The yarn is then taken up at a rate of 600 m/min. by the feed rollers 22 and then engaged with the fluid jet type interlacing device 8 as shown in FIGS. 17 and 20 in the manner as shown in FIG. 21. Thereafter, the yarn is taken up at a rate of 575 m/min. by the feed rollers 10.

The yarn is subjected to a slackening effect at a rate of approximately 10% in the zone defined between the fluid jet type interlacing device 8 and the feed rollers 20 (common to 22 in FIG. 3) and then caused to run in the manner as shown in FIG. 6. The amount of excessively fed yarn is 4.35% and, accordingly, a stretching rate in the order of 1.054 times (5.4%) between the interlacing device 8 and the feed rollers 30 is provided.

The slackening rate is expressed, when the running yarn is cut simultaneously at two different points therealong to obtain a sample of yarn, by the following formula:

$$\left(\frac{\text{Length of sample yarn}}{\text{Distance between two points}} - 1\right) \times 100\%$$

and the amount of excessively fed yarn (overfeed) is expressed by $$\left(\frac{\text{Feed rate of rollers 20}}{\text{Delivery rate of rollers 30}} - 1\right) \times 100\%.$$

The resultant yarn exhibits the form as shown in FIG. 13. A plain fabric woven from this yarn exhibits a plurality of looped protruding portions formed on its surface. When compared with a plain fabric woven from a conventional false twisted textured yarn, the plain fabric woven from the yarn of the present invention exhibits a touch which is much closer to that of a cotton yarn.

EXAMPLE 6

The same procedure as those of Example 5 are carried out except that the frictional resistor 9 is employed as shown in FIG. 22. A ceramic yarn guide made of titanium oxide is used as the frictional resistor 9. Such resistor is arranged so as to come into contact with the yarn at an angle of 90°. The portion of multifilament yarn $Y_1$ shown in FIG. 22 exhibits a slack rate in the order of 18%, and has snarl-shaped protruding portions S as shown in FIG. 5. The portion of multifilament yarn $Y_2$ shown in FIG. 22 exhibits a slack rate in the order of 10%, and slightly has snarl-shaped protruding portions S as shown in FIG. 7. A draft of 1.073 (7.3%) is provided by the frictional resistor 9.

The resultant yarn exhibits the form shown in FIG. 13 as obtained in accordance with Example 5, but has loop-like protruding portions which are longer than those exhibited by a fabric of the same standards as previously referred to in Example 5.

EXAMPLE 7

The same procedures as those of Example 5 are followed except that the number of false twists has been modified to 1850 T/m and 1300 T/m respectively. The resultant yarn exhibits the forms as shown in FIGS. 12 and 11, respectively.

EXAMPLE 8

The same procedures as those of Example 5 are followed except that the number of false twists has been modified to 1800 T/m and the feed rate of the feed rollers 30 as well as the amount of excessively fed yarn have also been accordingly modified. At an amount of excessively fed yarn of 3.5% or higher (corresponding to multifilament yarn $Y_1$'s slack rate of 5%), fabric woven from this yarn is provided with effective protruding portions; and at an amount of excessively fed yarn of 8% or higher (corresponding to multifilament yarn $Y_1$'s slack rate of 70%), the yarn is slackened upstream of the fluid jet type interlacing device 8 and therefore can no longer continue to run.

It is obvious that the higher the amount of excessively fed yarn is, the greater the number of protruding portions will be, so long as the amount of excessively fed yarn lies between 3.5% and 8%.

EXAMPLE 9

The same procedures as those of Example 8 are followed except that the feed rates of the respective rollers have been reduced by half. The yarn can continue to run until the amount of excessively fed yarn reaches 10% (corresponding to multifilament yarn $Y_1$'s slack rate of 85%).

EXAMPLE 10

A multifilament yarn composed of 66 nylon yarn (3D, 18 fil.) and polyethylene terephthalate yarn (3D, 36 fil.) is processed under the following requirements.

The interlacing devices shown in FIGS. 14 and 18 are used with respect to these requirements:

| | |
|---|---|
| Feed rate of rollers 10 | 206 m/min |
| Feed rate of rollers 20 | 200 m/min |
| Delivery rate of rollers 30 | 178 m/min |
| Temperature of heater 6 | 195° C. |
| Number of false twists provided by false twister | 1300 T/m |
| Working pressure of fluid jet type interlacing device 8 | 3.0 kg/cm$^2$ (G) |

The resultant yarn is used to obtain a plain fabric which is then dyed in such a manner that the 66 nylon can be dyed but the polyester cannot be dyed.

A plurality of looped and snarled filament portions protrude at random from the surface of the fabric and exhibit a roughly frosted appearance or heater effect.

The same procedures as these mentioned just immediately above are repeated except that the number of false twists has been modified to 1600 T/m. As a result, the above-mentioned roughly frosted appearance or heater effect becomes slightly finer.

The same procedures as those mentioned just immediately above are repeated except that the working pressure of the interlacing device 8 of the fluid jet type has been modified to 4.0 kg/cm$^2$ (G). As a result, the above-mentioned frosted appearance, or heater effect becomes even finer.

What we claim is:

1. A process for manufacturing a bulky textured multifilament yarn composed of a plurality of individual filaments having false-twisted crimps, having interlaced yarn sections and non-interlaced yarn sections formed alternately along the longitudinal axis of the yarn, and having a plurality of filament portions protruding from the yarn axis, said process comprising at least two steps:

slackening a multifilament yarn treated by a false twisting operation to such an extent that crimps of individual filaments are formed; the crimps of each of said filaments being irregularly distributed along its length as compared to the crimp distribution of other filaments of said yarn;

then interlacing said individual filaments of said slackened multifilament yarn by a fluid jet stream while taking up said multifilament yarn, whereby crimps of said individual filaments created by said flase twisting operations are maintained in said yarn during said slackening and interlacing treatment of said yarn.

2. A process for manufacturing a bulky textured multifilament yarn according to claim 1, further comprising a step of false twisting a multifilament supply yarn, wherein the number of false twists of the textured yarn is in accordance with the formula:

$$2000 \cdot \sqrt[4]{\rho/D} < T < 7000 \cdot \sqrt[4]{\rho/D}$$

where T represents the number of turns of twist per meter, D represents the denier of said supply yarn, and $\rho$ represents the specific gravity of said filaments.

3. A process for manufacturing a bulky textured yarn according to claim 1, wherein said fluid jet stream is directed to said yarn in a direction perpendicular to the lengthwise direction of said yarn.

4. A process for manufacturing a bulky textured multifilament yarn according to claim 1, further comprising a step of stretching a false-twisted multifilament yarn before subjecting said yarn to a slackening operation.

5. A process for manufacturing a bulky textured multifilament yarn according to claim 1, further comprising a step of stretching said yarn treated by said slackening step before subjecting said yarn to said interlacing treatment while said irregular distortions of filaments are maintained.

6. A process for manufacturing a bulky textured multifilament yarn according to claim 1, wherein the fed yarn is slackened in the order of 5% or higher during said yarn slackening step.

7. A process for manufacturing a bulky textured multifilament yarn according to claim 1, wherein said process employs a multifilament yarn which is composed of at least two kinds of filaments having different properties as the multifilament yarn to be supplied thereto.

8. A process for manufacturing a bulky textured multifilament yarn according to claim 1, further comprising a step of doubling at least two false twisted multifilament yarns under the same feeding speed, whereby said doubled yarn is used as a yarn to be supplied to said slackening step.

9. A process for manufacturing a bulky textured multifilament yarn according to claim 8, wherein one of said false twisted multifilament yarns to be supplied is false twisted by Z twists, while the other yarn is false twisted by S twists.

* * * * *